US007490958B1

(12) United States Patent
Stoddard

(10) Patent No.: US 7,490,958 B1
(45) Date of Patent: Feb. 17, 2009

(54) ILLUMINATED ELECTRICAL TRANSFORMER/POWER SUPPLY

(76) Inventor: James Marshall Stoddard, 509 Yampa Ave., Craig, CO (US) 81625

( * ) Notice: Subject to any disclaimer, the term of this patent is extended or adjusted under 35 U.S.C. 154(b) by 0 days.

(21) Appl. No.: 11/354,330

(22) Filed: Feb. 7, 2006

Related U.S. Application Data

(62) Division of application No. 10/800,304, filed on Mar. 12, 2004, now Pat. No. 7,004,595.

(51) Int. Cl.
*F21V 33/00* (2006.01)

(52) U.S. Cl. ..... 362/253; 362/95

(58) Field of Classification Search ..... 362/253, 362/190–191, 200, 205; 439/490, 107
See application file for complete search history.

(56) References Cited

U.S. PATENT DOCUMENTS 6,045,235 A * 4/2000 Hee ..... 362/183
6,290,533 B1 9/2001 Major
6,316,911 B1 * 11/2001 Moskowitz et al. ..... 320/114

OTHER PUBLICATIONS

U.S. Appl. No. 10/800,304, filed Mar. 12, 2004, Stoddard (patent allowed).

* cited by examiner

*Primary Examiner*—Ali Alavi

(57) ABSTRACT

An Illuminated Electrical Transformer/Power Supply assembly (143) utilizing an Illuminating module assembly (201B) comprising electrical light source (106), Controlling means (104) and remote electrical power source (103), contained within or upon electrical transformer or power supply housing. The illuminated electrical transformer or power supply is designed for the purpose of illumination while attaching the electrical transformer or power source to an electrical receptacle. The electrical light source (106) is positioned to illuminate an electrical receptacle to provide a lighted and clear view, enabling user to safely, accurately and conveniently connect the electrical transformer or power supply to the electrical receptacle.

3 Claims, 6 Drawing Sheets

ILLUMINATED ELECTRICAL TRANSFORMER/POWER SUPPLY

This application is a divisional and claims priority of application Ser. No. 10/800,304, filed Mar. 12, 2004, and now U.S. Pat. No. 7,004,595.

FEDERALLY SPONSORED RESEARCH

Not Applicable

SEQUENCE LISTING OR PROGRAM

Not Applicable

BACKGROUND OF THE INVENTION

Field of Invention

This invention relates to hand held, electrical transformers and power supplies equipped with remote electrical power and light sources for the purpose of illuminating electrical receptacles in low or obstructed lighting environments.

BACKGROUND OF THE INVENTION

Presently existing electrical transformers are very common and vital components providing converted power to a myriad of electrical devices.

There are occassions when the act of plugging the electrical transformer or power supply into a wall receptacle or extension cord is made more difficult because of darkness or obstructed light.

U.S. Pat. No. 6,290,533 (2001) to Major discloses a flashlight plug which is an illuminated male electrical plug and cord. It is designed to illuminate an electrical outlet while a user is in the process of attaching the plug to the receptacle. Drawbacks to this device include: disclosed in the form of a plug/cord, it cannot be used on existing devices without replacing the original electrical cord. Considering the vast difference of electrical cord designs, including mounting, strain relief, amperage ratings, and differences of electrical attachment found on electrical appliance power cords, providing this plug/cord with a safe and suitable universal design could become a very daunting and expensive proposal. Incorrect installation of the flashlight plug may cause potential for electrical shock and damage to the appliance. If not provided by the manufacturer as original equipment, to mount this plug/cord on an existing appliance may void a warranty (for equipment with warranty). Even if this plug were designed to replace the plug component of an existing power cord (cutting off the plug and attaching the Flashlight plug to the end of the power cable), the same hazards and shortcomings as mentioned above may still apply. For devices using a electrical transformer, this plug/cord, or plug only, is of no practical use. While this plug may be a useful device for a manufacturer to install as original equipment on electrical appliances, it has very limited use as a replacement cord or plug on the vast majority of existing appliances. Additionally, once the Flashlight Plug is installed onto a device, it becomes a semi-permanent component of that device and cannot easily be unattached for use on other electrical devices.

U.S. patent application Ser. No. 10/800,304 (Allowed 2006) to Stoddard discloses an "Illuminated Electrical Plug Adapter" which is designed to function as an illuminated electrical adapter between a factory installed electrical plug and an electrical receptacle. While this is a very useful concept, it too has a drawback in that it adds an amount of cumbersome weight and bulk to any transformer unit it is attached to. Many electrical transformers are used in travel for cell phones, computers, Ipods and the like and most commonly, compact, lightweight, space efficient device accessories are preferred.

It becomes apparent that an illuminated electrical transformer for receptacle illumination can be useful and provide substantial improvement over what is available today. No illuminated transformer units for receptacle illumination could be found in the prior art.

OBJECTS AND ADVANTAGES

Several objects and advantages of the present invention are:

(a) to provide the Illuminated Electrical Transformer or Power Supply using a light emitting diode as a possible light source;

(b) to provide the Illuminated Electrical Transformer or Power Supply using a small battery or remote power source and switch to provide and control power to the light source;

(c) to provide the Illuminated Electrical Transformer or Power Supply using an electrical circuit for recharging the battery or remote power sources;

(d) to design the Illuminated Electrical Transformer to fit on all types of existing transformers and/or power supplies;

(e) Still further objects and advantages will become apparent from a consideration of the ensuing description and drawings.

SUMMARY

In accordance with the present invention, my Illuminated Electrical Transformer/Power Supply comprises, an electrical light source, a power source, a switch, and an electrical circuit all fitted within or upon an Electrical Transformer or Power Supply for the purpose of illuminating the receptacle in which it is to be plugged.

Figure 1:
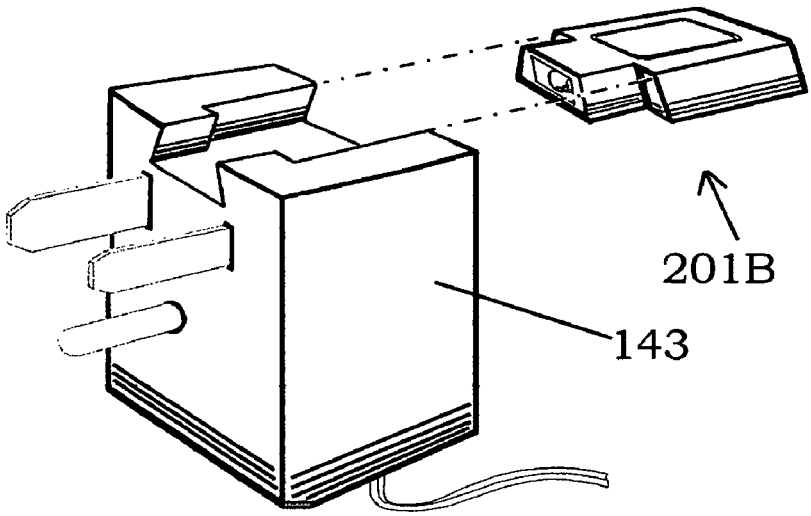
FIG. 1 is a perspective drawing of the present invention and how it may be attached to a specially designed wall mount transformer or power supply in a manner that illuminates a suitable receptacle.

| Drawings—Reference Numerals | |
|---|---|
| 100 | Light module case |
| 101 | Switch Cover |
| 102 | Diffusing Lens |
| 103 | Battery (Remote electrical power source) |
| 104 | Switch Contact |
| 105 | Battery (remote electrical power source) and Switch Holding Component |
| 105A | Battery (remote electrical power source) and Switch Holding Component for Recharging Embodiment |
| 106 | Electrical Light Source |
| 107 | Circuit Board |
| 107A | Circuit Board Equipped for Recharging Embodiment |
| 108 | Spring Metal Contactor |
| 108A | Circuit Board for Spring Metal Contactor |
| 109, 109A: | Recharging Conductor |
| 110, 111 | Wire Conductor |
| 112 | Resistor |
| 113 | Recharging contact board |
| 113A, 113B | Wire-Recharging Circuit |
| 113C | Location of Recharging Contact Board |
| 115 | Wire, Fuse Link-To Recharging assembly |
| 115A, 115B: | Wire-to Recharging Assembly |
| 116 | Transformer-Recharging assembly |
| 117 | Circuit Board-Recharging Assembly |
| 119, 119A, 119B, 119C | Rectifier |
| 120 | Recharging Circuit |
| 138 | Opening-Battery Installation and Replacement |
| 139, 139A | Conductor |
| 140 | Spacer |
| 141 | Illuminating Module Bracket |
| 142 | Adhesive Panel |
| 143 | Transformer/Power Supply Case |
| 201 | Illuminating Module of the Preferred Embodiment |
| 201A | Illuminating Module-Recharging Embodiment |
| 201B | Illuminating Module-Transformer/Power Supply Embodiment |
| 205 | Switch and Battery Holder Assembly |
| 205A | Switch and Battery (remote electrical power source) Holder Assembly-recharging Embodiment |
| 206 | Battery Contactor Assembly |
| 207 | Recharging Assembly |
| 209 | Conventional Electrical Transformer/Power Supply |

DETAILED DESCRIPTION

FIGS. 1,2,3,4,5,6,7,10,10A,11,12,13, —Preferred Embodiment For the purpose of promoting an understanding of the principles of the invention, reference employing specific language shall be made to the illustrated embodiments. Please note that no limitation of the scope of the invention is intended This includes any and all alterations or further modifications to any principle, application or conceivable use that might occur to any individual skilled in the art to which the invention relates.

Certain terminology is used in the following description for convenience purposes only and not intended to limit any aspect of the invention. The words "right", "Left", "Upper", "Lower", "Inside", "Outside", and "In front of" all designate the placement and location of components from the user's point of view. The word "User" is to mean a person using the Illuminated Electrical Transformer. The words "Led" and "Leds" are used throughout this work as a shortened term for "Light Emitting Diode" and "Light Emitting Diodes" they are mentioned as only a viable option for the remote electrical light source. So too does the term "Battery" refer to the "remote electrical power source". The terminology includes the words above, specifically mentioned, derivatives thereof and words of similar import.

FIG. 1 illustrates a perspective view of the illuminating module 201B fashioned to be attachable to the transformer 143.

Figure 2:
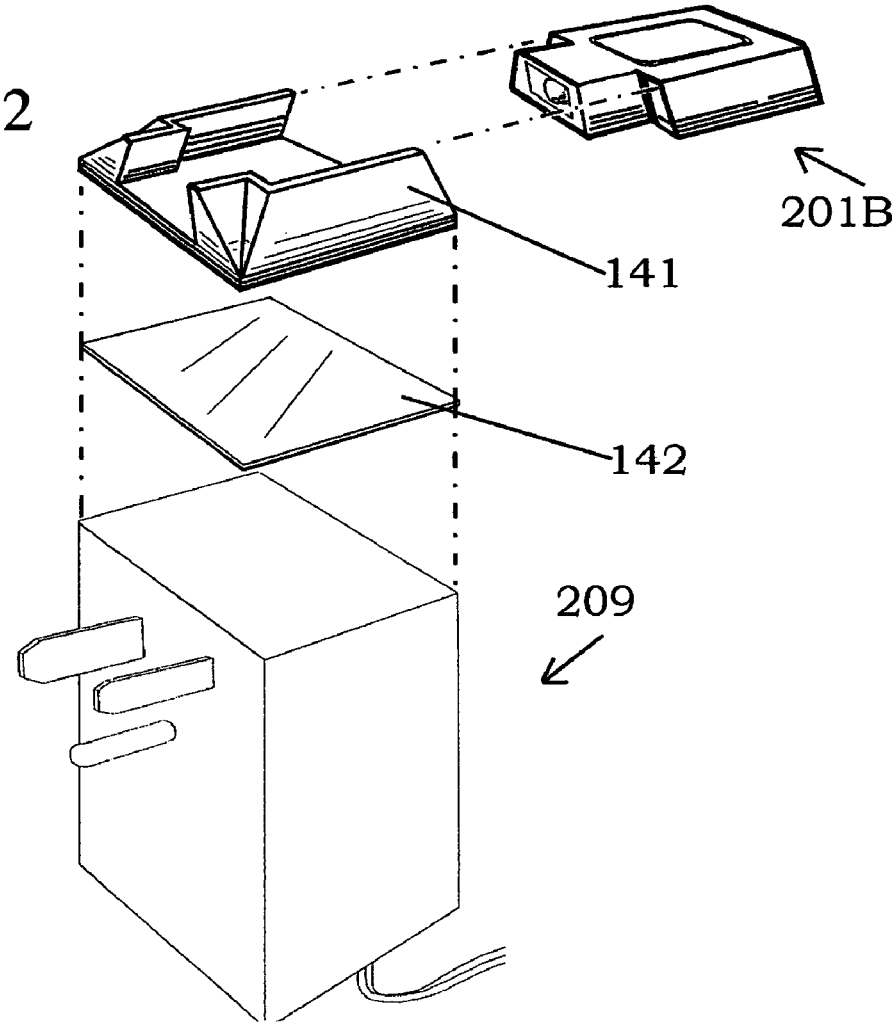
FIG. 2 is a perspective drawing of the present invention and how it may be attached to a conventional transformer or power supply in a manner that permits the illumination of a suitable receptacle.

FIG. 2 illustrates a perspective view of the illuminating module 201B fashioned to be attachable to Illuminating module bracket 141 which is attached to transformer 209 with adhesive panel 142.

Figure 3:
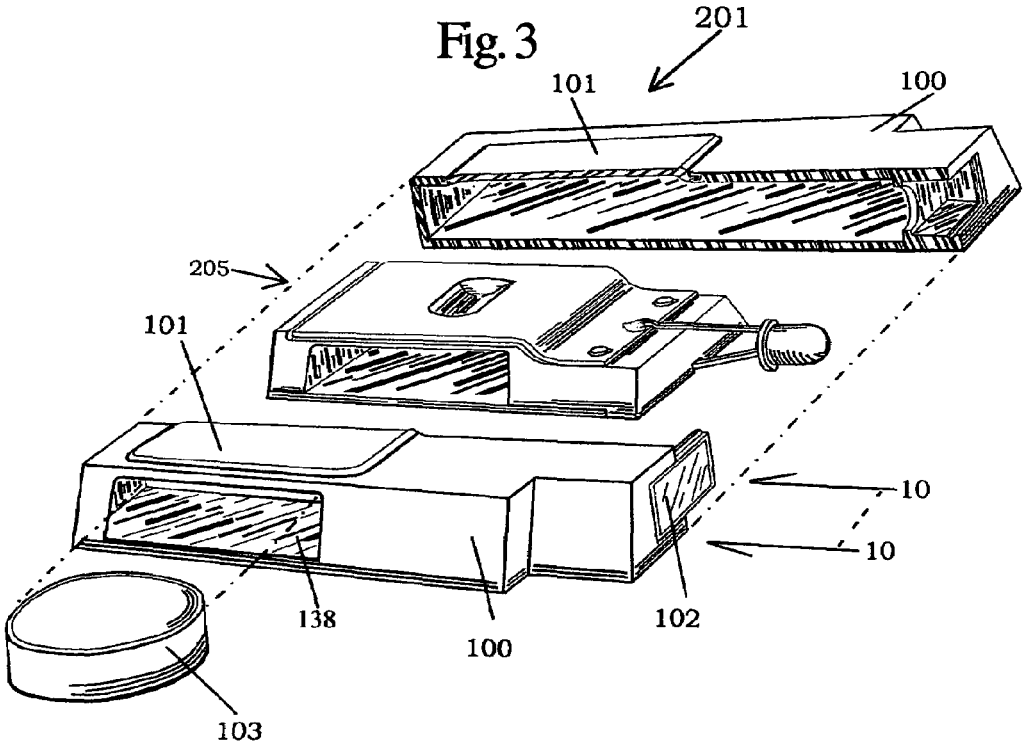
FIG. 3 is an exploded view of the present inventions lighting components
Figure 4:
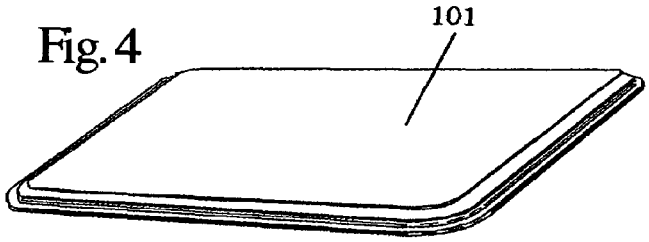
FIG. 4 is a magnified view of the flexible switch cover.
Figure 5:
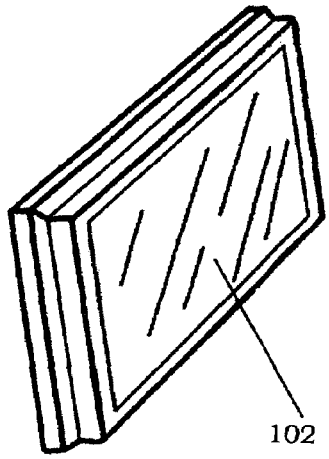
FIG. 5 is a magnified view of the optional diffusing lens

FIG. 3 illuminating module assembly 201 comprises Illuminating module case 100 and Switch cover 101 (FIG. 4) which encloses Switch and battery holder assembly 205 and battery 103. Switch cover 101 is molded or attached by any suitable means, or is a part of Illuminating module case 100 in order to provide a flexible seal which allows user to actuate Switch and battery holder assembly 205. Opening 138 allows installation and replacement of Battery 103. Optional Diffusing lens 102 (FIG. 5) is made of a suitable transparent material and is molded or attached by any suitable means to Illuminating module case 100.

Figure 6:
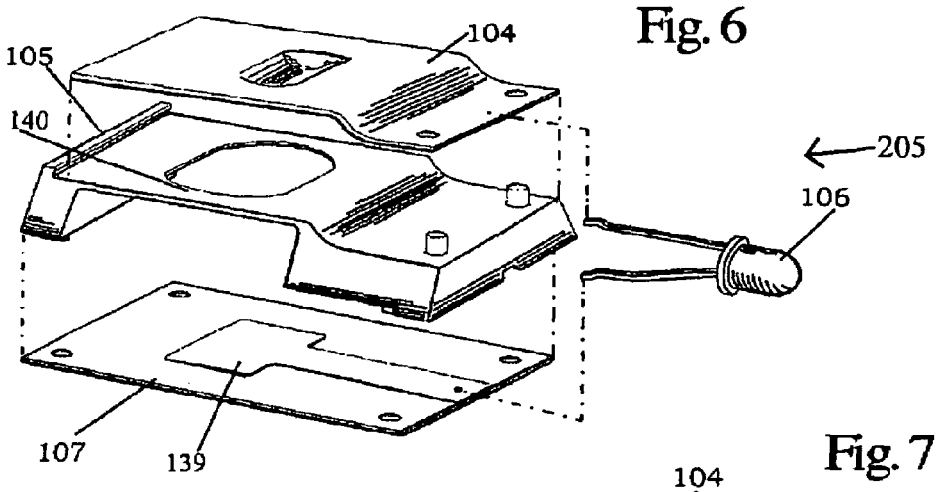
FIG. 6 is an exploded view of the switch and battery holding assemble.
Figure 7:
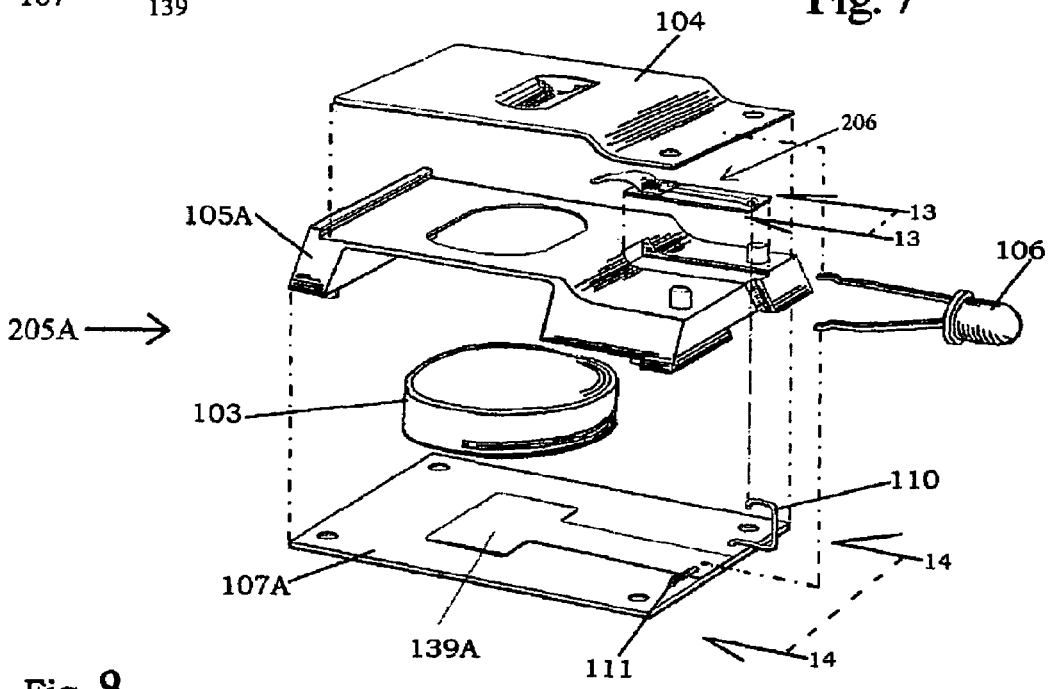
FIG. 7 is an exploded view of the switch and battery assemble modified to permit the recharging of the battery.

FIGS. 6 and 7 are exploded diagrams of the Switch and battery holder assembly 205. This assembly comprises Switch contact 104, Battery and Switch holding component 105, Circuit board 107, and Light emitting diode 106. The Battery and Switch holding component 105 is made of non-conductive material and is sandwiched between Circuit board 107 and switch contact 104; these components are adhesively combined or held together by any suitable means. This assembly forms Opening 138 (FIG. 3), which holds Battery 103 (FIG. 3) in place within the assembly and maintains electrical contact with Conductor 139. Spacer section 140 creates a space between Switch contact 104 and Battery 103. Switch contact 104 is electrically conductive and has a flexible characteristic enabling contact with the battery—a predetermined amount of force applied to the contact in a direction towards the battery causes physical and electrical contact with Battery 103. Light emitting diode 106 is electrically connected to Conductor 139 and Switch contact 104. When Switch contact 104 is electrically connected to Battery 103, electron flow through Led 106 is initiated and Led 106 will produce useful illumination.

Figure 11:
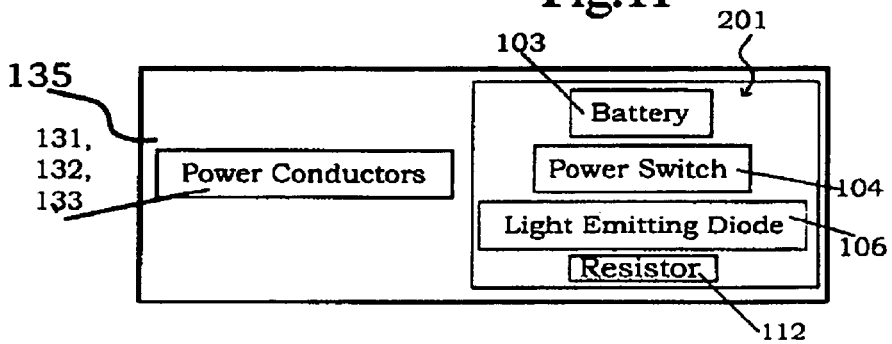
FIG. 11 is an electronic diagram of the preferred, non-recharging embodiment of the present invention.

FIG. 11 illustrates the electrical flowchart diagram of the preferred invention. Adapter body 135 houses Power conductors 131, 132 and 133, which allow electron flow from a receptacle, through the assembly and to the electrical transformer. Illuminating module assembly 201 is the switching mechanism for Electrical light source 106—the actual switching component is Switch contact 104. Switch contact 104 closes the circuit by electrically connecting Battery 103 to LED 106. Resistor 112, if needed is an amperage controlling component for LED 106.

FIG. 2 discloses another embodiment comprising Bracket 141 and Adhesive panel 142, designed to attach to an existing wall mount transformer 209. Adhesive panel 142 possesses adhesive on both sides to attach bracket 141 to Transformer 209, but any suitable means of attachment may be employed. Illuminating module 201 B is held in position by means of friction or any suitable means as is known in the art into bracket 141 in order to provide lighting onto an intended receptacle.

FIG. 1 demonstrates another mounting design for attaching illuminating module 201B to an electrical transformer. Electrical transformer case 143 is designed to hold Illuminating module 201B.

Figure 10:
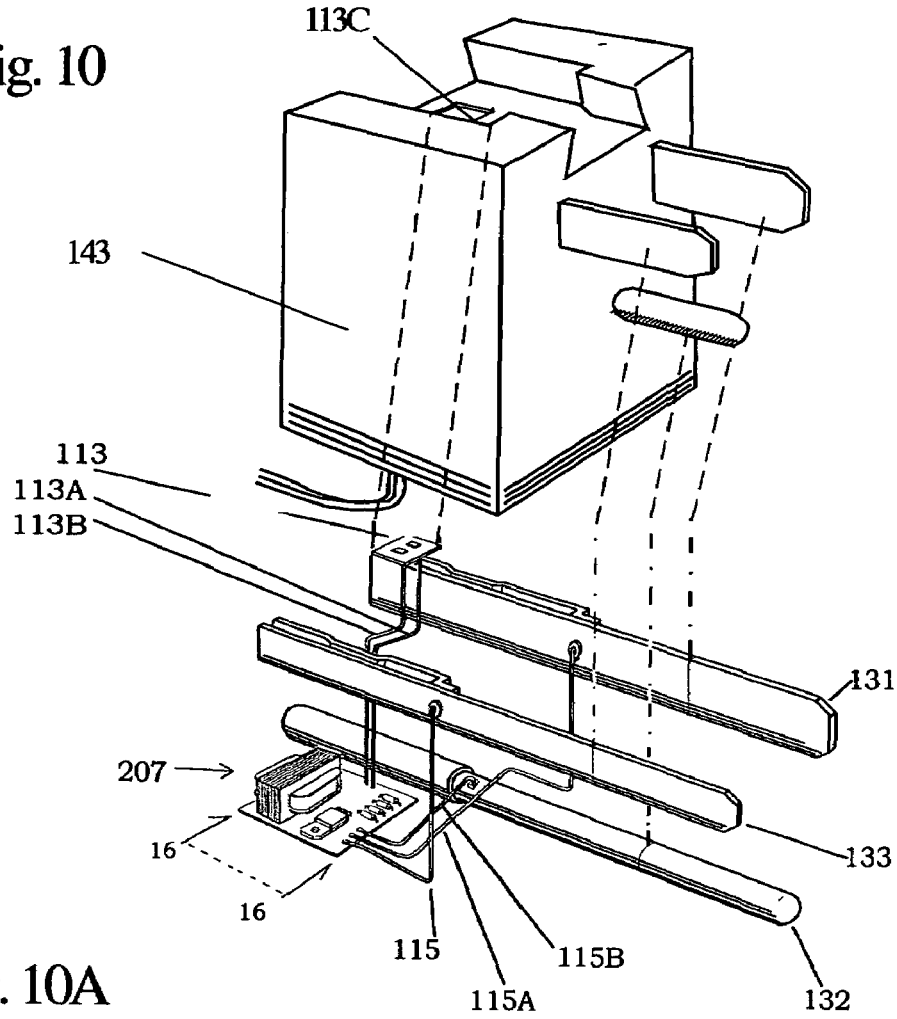
FIG. 10 is an exploded view of another embodiment of the present invention showing the addition of recharging components.
Figure 10A:
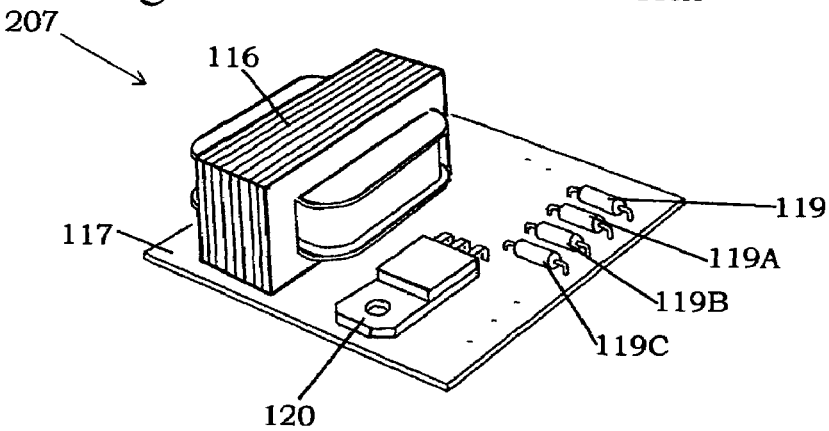
FIG. 10A is a magnified perspective view of the recharging circuitry
Figure 12:
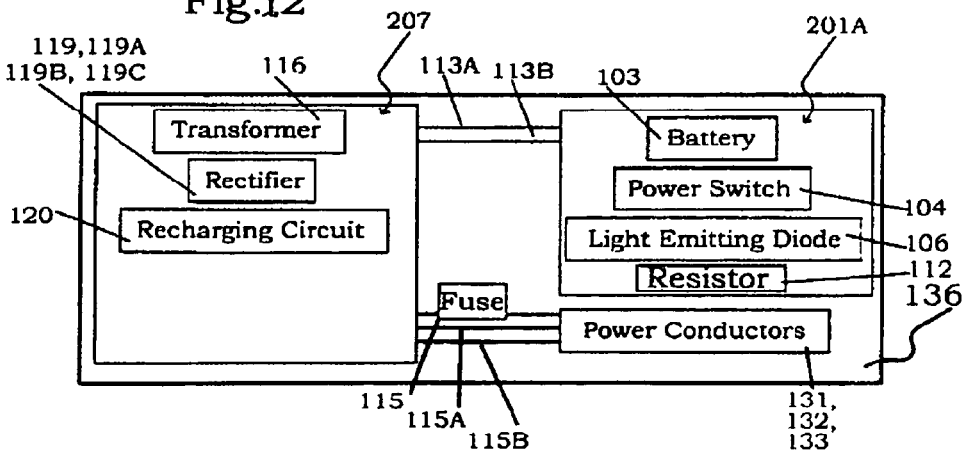
FIG. 12 is an electronic diagram of another embodiment of the present invention equipped for recharging of the battery.

Other embodiments may include a recharging circuit for Battery 103 (FIG. 12). FIG. 10A illustrates that Recharging assembly 207 located within Adapter body 137. Recharging assembly 207 (FIG. 10) contains the components to allow recharging functions as explained following.

Figure 8:
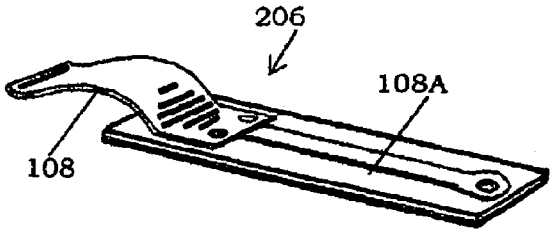
FIG. 8 is a magnified view of the electrical conductor that connects the battery to a recharging circuit.
Figure 9:
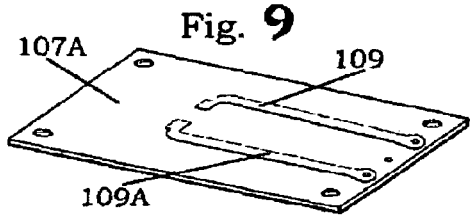
FIG. 9 is the inverse side of the circuit board showing the electrical conductors connecting the recharging circuit.

Referring again to FIG. 10A the recharging constituent begins with Power conductors 115, 115A and 115B. They function to convey line voltage to Recharging assembly 207. FIG. 10 shows a magnified perspective view of the assembly. The line voltage is stepped down to a suitable voltage by transformer 116 and sent to rectifier 119-119C. The DC voltage from the rectifier provides power to Recharging circuit 120, which may be any suitable recharging circuit as is known in the art to maintain the charge level of Battery 103 (FIG. 7). Referring to FIG. 10A, Conductors 113A and 113B through Recharging contact board 113, connect the output voltage from Recharging circuit 120 to illuminating module assembly 201 A. FIG. 9 shows the bottom of Circuit board 107 A. Conductors 109 and 109A electrically connect Recharging contact board 113 (FIG. 10A) to wires 110 and 111 (FIG. 7) The presence of Recharging contact board 113 eliminates the need to hardwire Illuminating module assembly 201A to the recharging circuit, allowing for simple removal and replacement of the assembly as shown in FIG. 10A. When Illuminating module assembly 201A is installed in Electrical Transformer case 143, Recharging contact board 113 physically aligns and electrically connects to Conductors 109 and 109A (FIG. 9) Wire 111 is a jumper from Conductor 109 to conductor 139A, connecting the circuit to one pole of battery 103. (Refer to FIG. 7) Wire 110 electrically connects the recharging voltage to Battery contactor assembly 206, which closes the recharging circuit. Battery contactor assembly 206 is shown in FIG. 8 and consists of two parts: Circuit board 108A and Spring metal contactor 108. This component maintains electrical contact with and allows voltage to flow to Battery 103 (FIG. 7) any time the illuminated electrical transformer is connected to an active receptacle.

FIG. 12 is an electrical diagram showing Recharging circuit 120 within Transformer body 136.

Operation of Preferred Embodiment and Additional Embodiments

See Drawings

Figure 13:
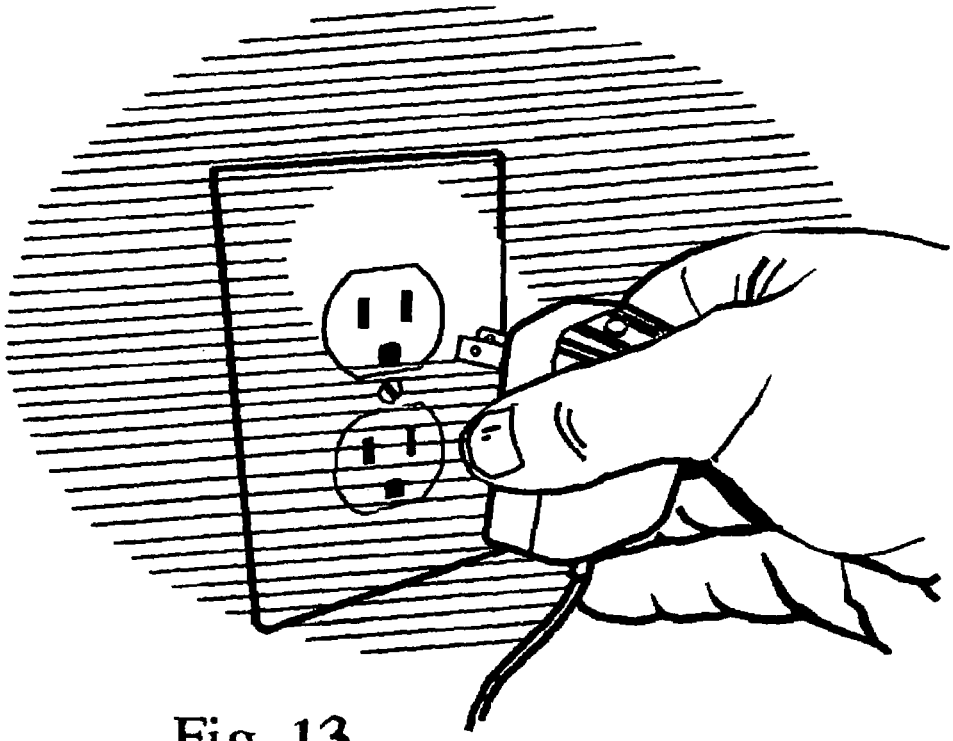
FIG. 13 is a perspective view, illustrating the intended function of the present invention illuminating an electrical receptacle.

As shown in FIG. 13 the function of the Illuminated Electrical Transformer is to illuminate a receptacle so a user can see to align and insert the Electrical transformer into an electrical receptacle safely and accurately in a low or no light environment.

To operate, In an area with low, obstructed or no light, grasp the electrical transformer or power supply in a manner that permits the engagement of the electrical switch. By depressing electrical switch cover 101 (FIG. 13) power is allowed to flow to the Remote electrical light source and light is created.

Move toward a suitable electrical receptacle and, using the illumination provided by the remote electrical light source, carefully align the electrical power conductors 131 and 132 into the appropriate openings of the electrical receptacle.

Once aligned, gently and completely press the electrical transformer or power supply into the receptacle.

As soon as the transformer or power supply is inserted completely, release the switch (or depress it again depending on the optional switch mechanism employed) to deactivate the illumination and let go of the transformer.

To replace the battery, Illuminating module assembly 201 (FIG. 3) is removed from transformer case 143 (FIG. 1) or illuminating module bracket 141 (FIG. 2) to gain access to Battery 103 (FIG. 3) The battery is removed from Opening 138 and a new battery is installed. Illuminating module assembly 201 is then inserted back into transformer case 143 or illuminating module bracket 141 (FIGS. 1 and 2)

In Regard to Operation and Battery Replacement, all Illumination Modules and assembles operate in the same manner.

The addition of the Recharging assembly 207 (FIG. 10) may be present in any Illuminated electrical Transformer assemblies.

ADVANTAGES

From the description above, a number of advantages of my illuminated electrical transformer/power supply become evident:

(a) Use of the illuminated transformer provides a directed light source, clearly illuminating the intended electrical receptacle.

(b) The intended device combines the features of separate devices (electrical transformers and portable lighting) into one device. Combined, these features offer a higher level of safety and convenience than what is currently available. An example of this would be the ability to locate and illuminate a receptacle in a darkened area using just the illuminated electrical transformer.

(c) By illuminating the receptacle, a user can see to accurately align and safely insert the transformer.

(d) The illuminating module can use a low power light emitting diode so the battery will have a very long run time. When the battery eventually does fail, the user can easily replace the dead battery and restore the entire unit to new condition.

(e) The illuminated Electrical Transformer can utilize a recharging circuit that will keep the battery recharged, enabling an even greater battery life expectancy. Situations where battery life may be shortened by constant use can benefit from this charging configuration.

CONCLUSION, RAMIFICATIONS AND SCOPE

Accordingly, the reader will see that, compared to using a standard transformer or power supply, my illuminated electrical Transformer can provide a user with an unobtrusive and inexpensive means to more safely and easily perform this very common, everyday task of plugging an electrical transformer into a receptacle. Furthermore, my Illuminated Electrical Transformer/Power Supply provides additional advantages in that:

(a) The present invention enables a user to easily locate a receptacle in a completely dark environment.

(b) The present invention is designed to be, optionally used with conventional electrical transformers thereby allowing use of the illumination module on any transformer or power supply.

(c) The illuminating module is detachable for battery or module replacement.

(d) The present invention and additional embodiments enable user to provide to a variety of electrical transformers, an affordable, temporary and quick conversion from non-illuminated to illuminated.

Although the description above contains many specificities, these should not be construed as limiting the scope of the invention but as merely providing illustrations of some of the presently preferred embodiments.

Thus the scope of the invention should be determined by the appended claims and their legal equivalents, rather than by the examples given.

I claim:

1. An Illuminating module for attachment to electrical transormers and power supplies comprising:

(1) an electrical light source (2) at least one remote electrical power source (3) an enabling means to control electrical power flow from said remote electrical power source to said electrical light source, and a bracket for attachment of said illuminating module to an exterior portion of said transformer or power supply wherein said illuminating module being attachable to said bracket, and wherein said electrical light source, when activated, being positioned to illuminate an area including and forward of power conductors of said electrical transformer or power supply, and whereby a user may activate said electrical light source and illuminate a receptacle for the purpose of accurately connecting said electrical transformer or power supply to an electrical receptacle.

2. An illuminating electrical transformer or power supply housing comprising:

a transformer or power supply case, and an illuminating module comprising;

(1) an electrical light source (2) at least one remote electrical power source (3) an enabling means to control electrical power flow from said remote electrical power source to said electrical light source, wherein said transformer case being fashioned to contain said illuminating module, and wherein said electrical light source, when activated, being positioned to illuminate an area including and forward of the position where the receptacle attaching portion of power conductors of said electrical transformer or power supply case would potentially be located, whereby an electrical transformer or power supply may be designed using said electrical transformer or power supply case to contain said illuminating module, and whereby a user may activate said electrical light source and illuminate a receptacle for the purpose of accurately connecting the electrical transformer or power supply to an electrical receptacle.

3. The illuminating electrical transformer or power supply housing of claim 2 further including a recharging circuit embedded within said electrical transformer or power supply housing, an electrical connection means connecting said recharging circuit to said remote electrical power source, wherein said recharging circuit providing electrical power for recharging of said remote electrical power source.

* * * * *